US008047522B2

(12) United States Patent
Silberbauer

(10) Patent No.: US 8,047,522 B2
(45) Date of Patent: Nov. 1, 2011

(54) CLAMP FOR PERFECT BINDER AND PERFECT BINDING METHOD

(75) Inventor: Günther Silberbauer, Uerkheim (CH)

(73) Assignee: Mueller Martini Holding AG, Hergiswil (CH)

( * ) Notice: Subject to any disclaimer, the term of this patent is extended or adjusted under 35 U.S.C. 154(b) by 64 days.

(21) Appl. No.: 12/432,413

(22) Filed: Apr. 29, 2009

(65) Prior Publication Data

US 2009/0274536 A1 Nov. 5, 2009

(30) Foreign Application Priority Data

Apr. 30, 2008 (EP) ..... 08155486

(51) Int. Cl.
*B42C 11/04* (2006.01)

(52) U.S. Cl. ..... 270/52.18; 270/58.07; 412/4; 412/19; 412/28

(58) Field of Classification Search ..... 270/58.07, 270/52.18; 412/4, 5, 19, 21, 25, 28
See application file for complete search history.

(56) References Cited

U.S. PATENT DOCUMENTS 6,607,070 B2 * 8/2003 Brommer et al. ..... 198/621.1
6,726,425 B1 * 4/2004 Schmidknoz ..... 412/8
6,966,553 B2 * 11/2005 Rathert ..... 270/52.18
7,467,450 B2 * 12/2008 Rygol et al. ..... 29/33 K
2002/0046813 A1 * 4/2002 Merkli ..... 156/556
2007/0209752 A1 * 9/2007 Rygol et al. ..... 156/209

FOREIGN PATENT DOCUMENTS

| | | | |
|---|---|---|---|
| CH | 325096 | | 10/1957 |
| CH | 414544 | A1 * | 5/1966 |
| DE | 100 57 599 | | 5/2002 |
| EP | 414544 | | 6/1966 |
| EP | 0 895-872 | | 2/1999 |
| EP | 895872 | A1 * | 2/1999 |
| EP | 1 344 655 | | 9/2003 |

OTHER PUBLICATIONS

European Search Report dated Oct. 12, 2008 from corresponding Application No. 08155486.7.

* cited by examiner

*Primary Examiner* — Patrick Mackey
(74) *Attorney, Agent, or Firm* — Venable LLP; Robert Kinberg; Steven J. Schwarz

(57) ABSTRACT

A perfect binder for processing book blocks, including: a conveying device adapted to convey the book blocks along a closed circulating path, the conveying device including a plurality of clamping devices each adapted to convey a book block; and a plurality of processing stations arranged successively along the closed circulating path. One of the processing stations includes a spine-processing station, and another one of the processing stations includes an end sheet feed station following the spine-processing station.

16 Claims, 13 Drawing Sheets

CLAMP FOR PERFECT BINDER AND PERFECT BINDING METHOD

CROSS-REFERENCE TO RELATED APPLICATIONS

This application claims the priority of European Patent Application No. 08155486.7, filed on Apr. 30, 2008, the subject matter of which is incorporated herein by reference.

BACKGROUND

The invention relates to a perfect binder used for processing book blocks, wherein the binder comprises a conveying device with a closed circular path for conveying the book blocks. A number of successively following processing stations are assigned to the conveying device, wherein the conveying device furthermore is provided with a number of clamping devices for respectively conveying one book block to the processing stations and wherein one of the processing stations is embodied for processing the book block spine. The invention furthermore relates to a corresponding perfect binding method.

For hardcover book production, book binderies are increasingly confronted with the task of having to produce smaller book block series, frequently involving only one copy of a book. For that reason, printing machines requiring short retooling times are generally used for printing the content of these books. Short runs are most often produced with digital printers, which make it possible to dynamically change the printing content, thus making it possible to sequentially print the pages of a book and then process these further into a book block. In most cases, this is done in-line, meaning the required processing steps starting with the printing, the folding and collating of the printed sheets, the perfect binding, all the way to the finishing of the bound book, are successive, and are realized in the same system, which is also called a book-binding line.

During a perfect binding operation, the individual sheets and/or signatures previously gathered into a book block are processed through milling along the spine, which is followed by applying adhesive along the spine. A casing is then pressed against the spine, such that the casing and the book block spine are glued together. If a flexible casing is used, then the finished product is called a perfect-bound softcover. If a rigid casing is used, the finished product is referred to as a perfect-bound hardcover.

For hardcover book production, the book block is provided with end sheets that are glued with the aid of a thin bead of glue onto both sides of the book block. In the finished book, these end sheets function as hinges to the casing. To be able to align the end sheets cleanly and flush with the book block spine, they are advantageously supplied only after the milling operation. A backing strip is then attached to the book block spine, such that it overlaps the spine, for example with the aid of hot glue or PUR (polyurethane reactive adhesive). The backing strip applied in this way ensures that the book block is held together. In the following step, the book block is then trimmed to the specified format and a hardcover is attached with adhesive to the two end sheets.

A perfect binder with a compact design is known from the Swiss patent document CH 325096. The perfect binder includes a conveying device having a closed circulating path, and processing stations arranged in the region of the circulating path. The conveying device is embodied as a rotating table with gripper holders arranged along the periphery, in which respectively one pair of clamping jaws is positioned which holds the book block. Owing to the fact that the clamping jaws hold the book block throughout the processing operation, the end sheets must be supplied to the perfect binder jointly with the book block, meaning prior to the milling of the back, which causes the above-mentioned quality problems.

European patent document EP 1344655 A2 discloses a perfect binder, especially suited for short runs, with the feed station arranged downstream of the milling device. The system disclosed therein is a linear, relatively long system. It includes several processing stations arranged successively in a row, with intermittent book block conveying, which is realized with a back-and-forth moving conveying device. In the process, the book block is conveyed while positioned on its spine, and is gripped in the lower region on both sides by a clamping bar. The clamping bar is part of the conveying device, and transports the book block through the milling device and into the feed unit for the end sheets. Once there, the book block is transferred to a holding clamp, which grips the book block in the center region. Immediately thereafter, the clamping bars are released and the end sheets, as well as the backing strip, are supplied to the book block. The two clamping bars meanwhile return to the starting position to take over the next book block. As the next book block is supplied, a back region of the clamping bars takes over conveying the book block that was previously provided with the end sheets and backing strip, so as to transport it to the following processing station.

The above-described return movement of the clamping bars, however, is slower than the movement for feeding the end sheets and the backing strip, meaning the book block processed in this station is ready for the further processing before the clamping bars have reached the starting position. As a result of the back-and-forth movement of the conveying device, the cycle time of the perfect binder is therefore extended unnecessarily.

The clamping bars furthermore press together the book block near the spine, and thus compress it in the lower region. In the unit for feeding the end sheets, the book block, which is loose in the upper region, is gripped by the holding clamp while the clamping bars are still engaged. The clamping bars subsequently opened up to clear the way for supplying the end sheets. Being encircled by the clamping device unsettles the book block and can result in inaccuracies and displacements. For example, a voluminous book block must be squeezed or compressed thoroughly because the air trapped inside the book block must first be allowed to escape. In the process, the previously created milling surface can be damaged, thereby leading to problems with the adhesive application and thus the quality of the final product. A relatively high technical expenditure is furthermore required to achieve the necessary precision during the above-described transfer of the book block from the conveying device to the holding clamp. Finally, the end sheets can be supplied to the book block only during a phase where the system is stopped.

SUMMARY

It is therefore an object of the present invention to provide a perfect binder with a compact design that is suitable for short runs, comprises a conveying device with a closed circulating path, allows supplying the end sheets after the book block spine has been milled, makes it possible to achieve a better quality of the perfect-bound brochures and books with simultaneously reduced technical expenditure, and/or permits a higher output. Another object of the invention is furthermore to provide a corresponding method for perfect binding.

The above and other objects are achieved according to one aspect of the invention wherein there is provided a perfect binder for processing book blocks, comprising: a conveying device adapted to convey the book blocks along a closed circulating path, the conveying device including a plurality of clamping devices each adapted to convey a book block; and a plurality of processing stations arranged successively along the closed circulating path; wherein one of the processing stations comprises a spine-processing station, and another one of the processing stations comprises an end sheet feed station following the spine-processing station.

According to another aspect of the invention there is provided a method for the perfect binding of book blocks, comprising: conveying the book blocks around a closed circulating path with each book block clamped in a clamping device of a conveying device, wherein a plurality of processing stations are arranged successively along the closed circulating path; milling the spine of each book block at one of the processing stations; and subsequently, inserting at least one end sheet into the clamping device at a downstream end sheet feed station.

As a result of the invention, the end sheets can be supplied for the first time after the milling of the book block spine, even with a perfect binder that has a compact design and/or includes a conveying device with a closed circulating path.

The clamping devices can be attached on or in the conveying device, and may each be provided with one outside gripper as well as an inside gripper for the book blocks. The inside gripper can be positioned inside the outside gripper. Owing to this arrangement of a gripper inside a gripper, the book block can be held by the inside gripper throughout the time spent in the perfect binder, while the outside gripper is opened up for feeding in the end sheets, thus creating the necessary clearance space for the end sheets. Therefore, neither a reverse movement nor an encircling by the clamping devices is required, and the associated disadvantages known from the prior art can be omitted. This type of arrangement furthermore makes it possible to position two grippers in such a way that book blocks can be accommodated independent of their block thickness and other format dimensions. That is to say, each of the successively following clamping devices can hold and transport a book block with different dimensions.

In an embodiment of the invention, the outside gripper is provided with an immovable and a movable gripper half while the inside gripper has two movable gripper halves. As a result of a radial displacement of the movable gripper half and the inside gripper, it is particularly easy to create the radial clearance space needed for supplying the end sheets on both sides of the inside gripper holding the book block. The gripper permits a fast opening and closing, with simultaneously secure and defined holding of the book block, thus increasing the output of the perfect binder and the quality of the perfect-binding process.

The outside gripper according to a different embodiment of the invention is provided with two first holding elements while the inside gripper has two second holding elements, wherein these holding elements are respectively positioned such that they can be pivoted around a common axis of rotation. With this alternative embodiment of the clamping device, the two grippers can be opened and closed relatively easily and independent of each other.

In the outside gripper, meaning its holding elements, respectively one pocket-type recess is provided that extends through these elements. The recesses makes it particularly easy to feed the end sheets through the holding elements of the outside gripper, wherein the end sheets in the clamping devices are initially stored temporarily at the level of the pocket bottom and are supplied only later on to the respective book block and pressed against this book block. Owing to the short distance downward from the pocket bottom, the dropping height for the end sheets is low, thus avoiding a "jumping" of the end sheets and ensuring a precise gluing together of the end sheets and the book block.

According to a further embodiment of the invention, the clamping devices are respectively provided with a first gripper for the book blocks, which is attached on or in the conveying device, and a second gripper attached to the feed station for the end sheets. The second gripper is arranged above and at a distance to the first gripper. The first gripper and the second gripper each include a first gripper half and a second gripper half, wherein at least one gripper half is embodied movable relative to the other gripper half. Since the second gripper is embodied separately, the first gripper can have a simpler design.

The book blocks are initially gripped in the lower region by the clamping devices, meaning the first grippers, and are conveyed to the processing stations. A book block conveyed to the following processing station is gripped by the second gripper in the upper region, whereupon the respective clamping device is opened. The at least one end sheet is then inserted into the opened clamping device. The clamping device subsequently closes again and the second gripper opens up, so that the book block supplied in this way with the end sheets is released once more and can be conveyed to a further processing station.

With the above-described gripper variants, the end sheets are supplied in two steps, meaning the end sheets are inserted in a first step into the respective clamping device, above and at a distance on the side to the book blocks. In a second step, the end sheets are moved downward to the level of the book block and pressed against it. The dropping height for the end sheets is thus reduced in the second step, thereby ensuring a precise gluing together of the end sheets and the book block. Of course, the end sheets can also be supplied during a single operational step.

At least one reading device for identifying the end sheets may be arranged on the feed station for the end sheets and/or at the clamping devices. This reading device makes it possible to detect identifying features on the end sheets and compare these to previously read identifying features on the respective book block. If the end sheets do not match the respective book block, it will trigger a removal of the book block or a corresponding action by the machine operator.

The conveying device may be driven continuously and the end sheets may be respectively provided to a clamping device that moves forward in conveying direction. The capacity of the perfect binder can be maximized in this way since the system is not stopped at any time.

According to an alternative embodiment, the conveying device is driven intermittently and the end sheets are respectively provided while the clamping device is stopped. The feed station for the end sheets can thus have a simpler design because the book blocks are not moving.

It is advantageous if the processing stations and especially the feed station for the end sheets are each provided with a separate drive. As a result, the processing stations can be operated independently and can be optimized for time-critical sequences.

Finally, the circulating path for the conveying device can be embodied circular, oval, rectangular or as a non-circular curve, thereby making it possible to adapt the conveying device without problems to any conceivable application.

BRIEF DESCRIPTION OF THE DRAWINGS

The foregoing and other features and advantages of the invention will be further understood from the following detailed description of embodiments of the invention, with reference to the accompanying drawings, wherein.

DETAILED DESCRIPTION

Figure 1:
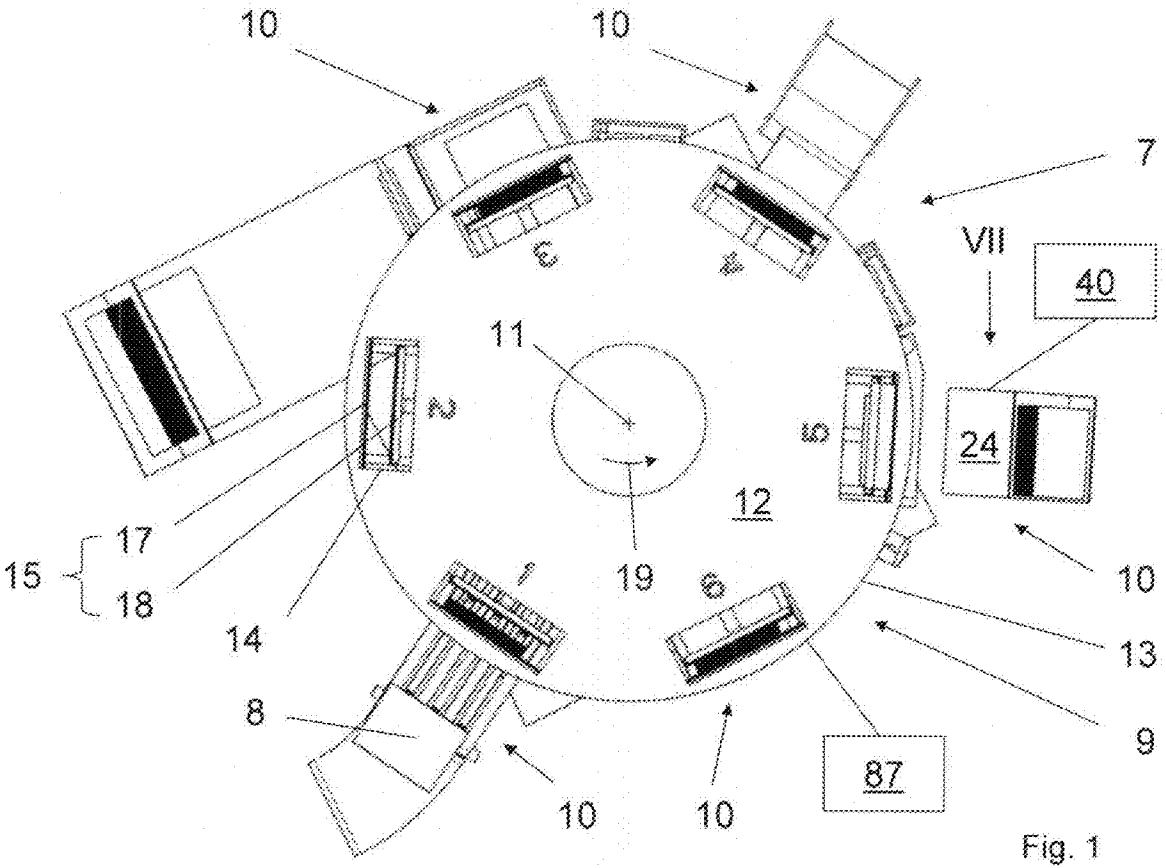
FIG. 1 is a top view of a perfect binder.

FIG. 1 shows a top view of an embodiment of a perfect binder 7 for processing book blocks 8 into perfect-bound books, which can subsequently be encased in a hardcover along a book-binding line. The perfect binder 7 is driven by a drive element embodied as a motor, which is not shown herein. Of course, it is also possible to use a hydraulic or pneumatic drive element or several drive elements. The perfect binder 7 comprises a conveying device 9 as well as a number of processing stations 10. The conveying device 9 is embodied as a round table 12 with a closed, circulating path 13, which rotates around an axis 11. The table 12 is provided along its periphery with six uniformly spaced-apart gripper holders 14, which each accommodate one clamping device 1, 2, 3, 4, 5, 6 for the book blocks 8. The clamping devices 1-6 are embodied as perfect binder grippers each having one outside gripper 15 and one inside gripper 16 (see FIG. 2). The outside grippers 15 are arranged at a 60° angle relative to each other, and each include a fixed gripper half 17 and a movable gripper half 18, wherein the movable gripper halves 18 are connected to lifting mechanisms (not shown) for the opening and closing of the grippers on the perfect binder. During the operation of the perfect binder 7, the clamping devices 1 to 6, meaning the outside and the inside grippers 15, 16, both follow a circulating path, which is concentric to the circulating path 13 of the table 12. The processing stations 10 are arranged successively in conveying direction 19 of the table 12, either below or above the table 12. Of course, the processing stations 10 can also be arranged beside the table 12.

Figure 2:
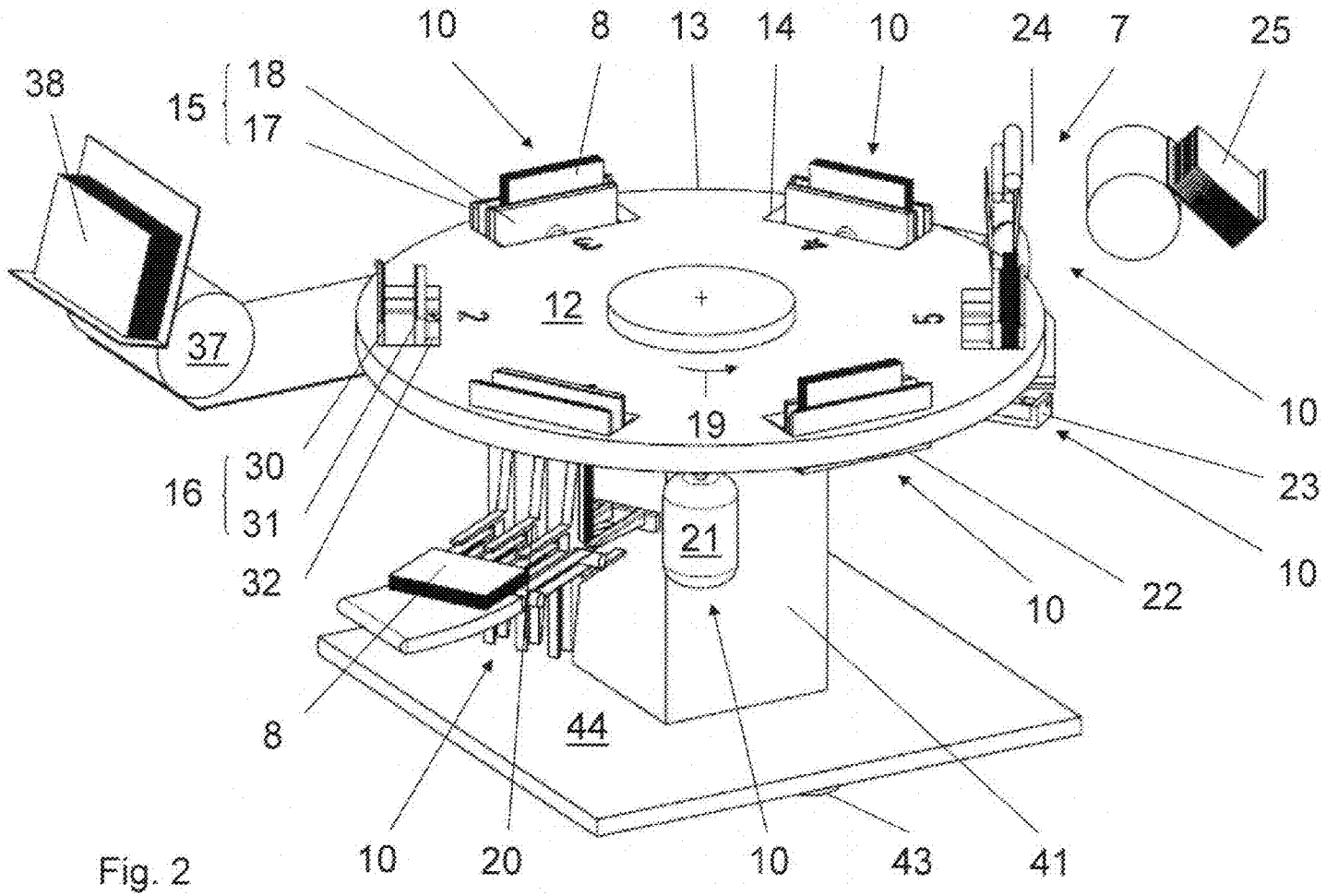
FIG. 2 is a perspective view of the perfect binder according to FIG. 1.

Some of the processing stations 10 can be seen in further detail in FIG. 2, which shows the perfect binder 7 in perspective view. The first processing station 10 is a feed device 20 for supplying the book blocks 8, which is arranged below the table 12. In order to save cycle time, the feed device 20 is embodied as a star-shaped device that does not require a return movement for conveying the following book block 8. The book blocks 8 are supplied from below, either during the operation of the perfect binder 7 or while it is stopped. The feed device can alternatively also be arranged above the table 12, on the side, or even tangential thereto. A jogger (not shown) can also be installed for the clean alignment of the book blocks. The format of the book block 8 can additionally be measured inside the feed device 20 or can be identified with a reading device (not shown).

Immediately following the feed device 20 is a second processing station 10, embodied as a device 21 for milling the book block spine, wherein this device is used to create a straight and roughed-up spine on the book block 8. An intermediate opening table 22 follows as the third processing station 10, which in turn is followed by an adhesive applicator 23, arranged below the table 12, for applying adhesive to the sides. This is followed by fourth and fifth processing stations 10, which are embodied as feed stations 24 for two end sheets 25.

Figure 3:
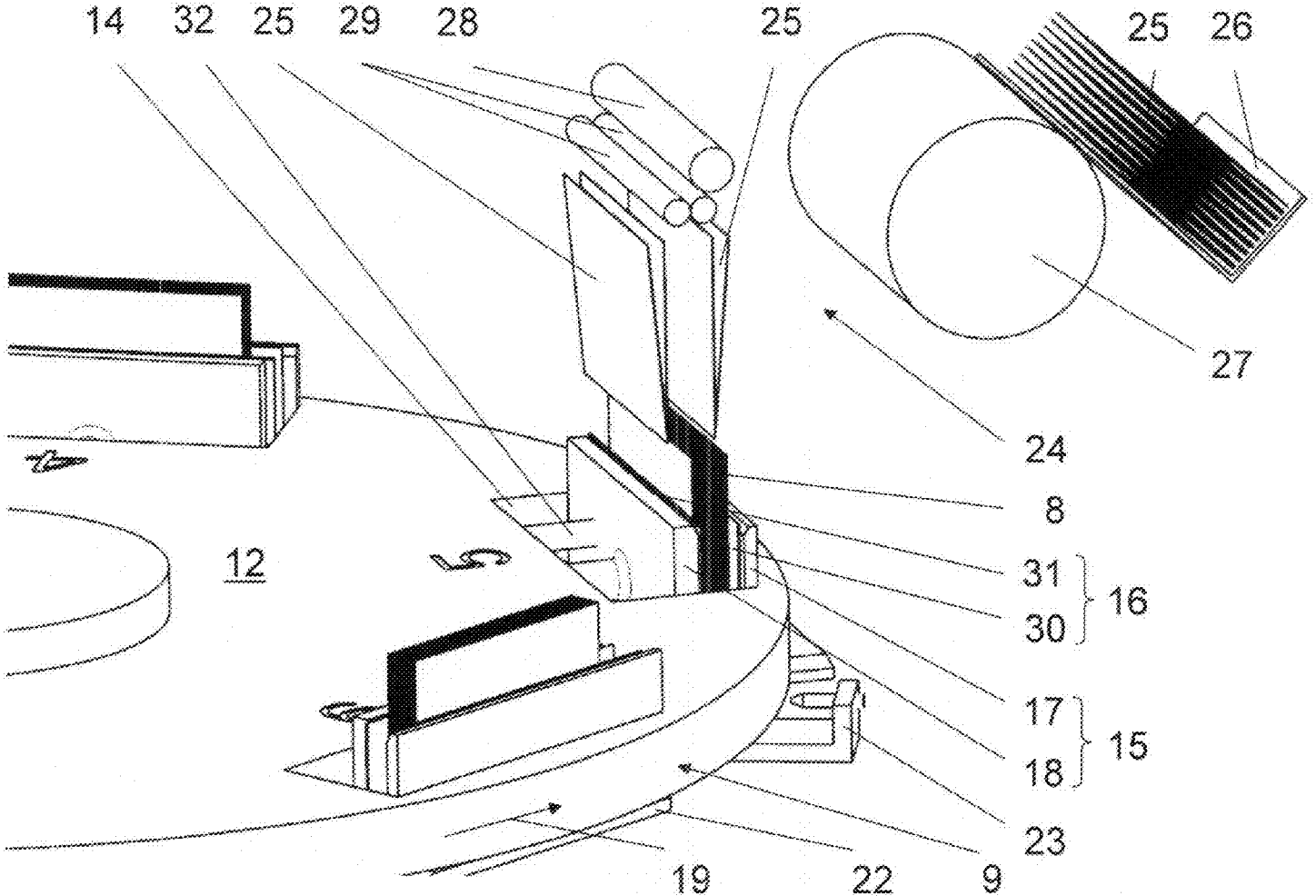
FIG. 3 is an enlarged detailed view of a feed station for the end sheets.

FIG. 3 is an enlarged representation of the feed station 24, and the clamping device 5 currently located in that region. The feed station 24, which is arranged above the conveying device 9, comprises a magazine 26, a withdrawing roller 27, a feed roller 28, and a pair of distribution rollers 29 for the end sheets 25, as well as conveying means (not shown) that extend between the rollers 27, 28, 29.

In the same way as the clamping devices 1 to 4 and 6, the clamping device 5, which is shown enlarged in FIG. 3, includes, in addition to the outside gripper 15, an inside gripper 16, arranged inside the outside gripper 15. The inside gripper has two movable gripper halves 30, 31 in the form of plates. One end of bolt 32 acts on both sides upon the outer region of the two gripper halves 30, 31 and extends through the table 12. The other end of the bolt 32 is connected to a drive (not shown), and is respectively controlled with the aid of a motor or hydraulic means, for example, a control cam. When the gripper 15 is open, the book block 8 can be displaced with the inside gripper 16 in the gripper holder 14, in the radial direction and relative to the outside gripper 15.

Figure 4:
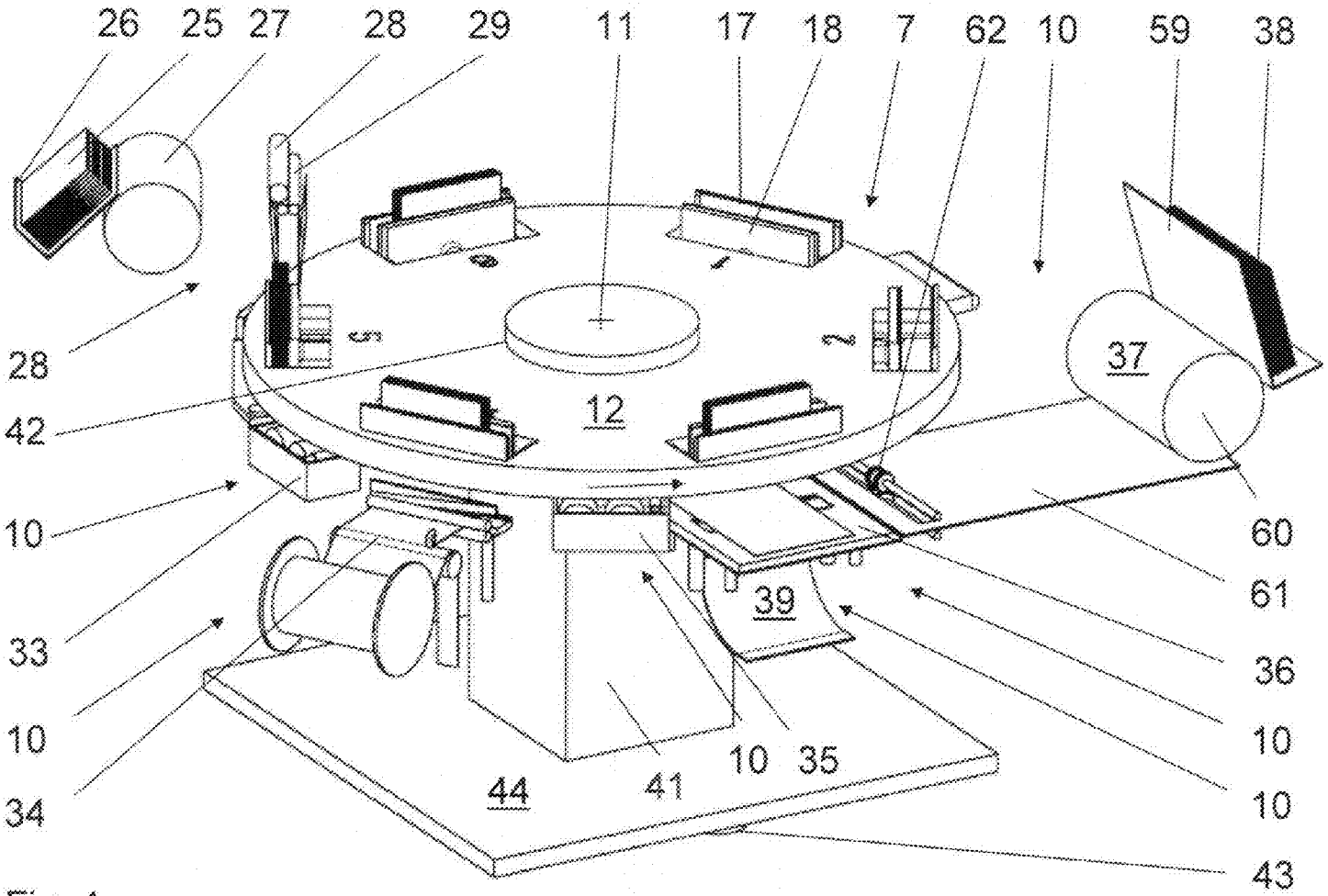
FIG. 4 is a perspective view of different processing stations along the perfect binder.

Referring to FIG. 4, an adhesive applicator 33 and a station for applying the backing strip 34 form the sixth and seventh processing stations 10, respectively, on the perfect binder 7. These are followed by an additional adhesive applicator 35 and a pressing-on station 36 as eighth and ninth processing stations 10, respectively, for the casings 38. The casings 38 are provided by a casing feeder 37 in the form of a drum feeder that forms the tenth processing station 10. The eleventh and last processing station 10 is a delivery station 39. According to an embodiment, the individual processing stations 10 are each provided with a separate drive 40 (shown diagrammatically in FIG. 1 for feed station 24). Alternatively, the processing stations 10 can be driven jointly in groups.

The table 12 is fitted onto a support 41 and is driven to rotate around is axis 11. The axis 11 is positioned inside the support 41 and is fixedly connected to the table 12 via a connecting element 42. The support is attached to a platform 44 that is positioned with legs 43 on the ground.

Figure 5:
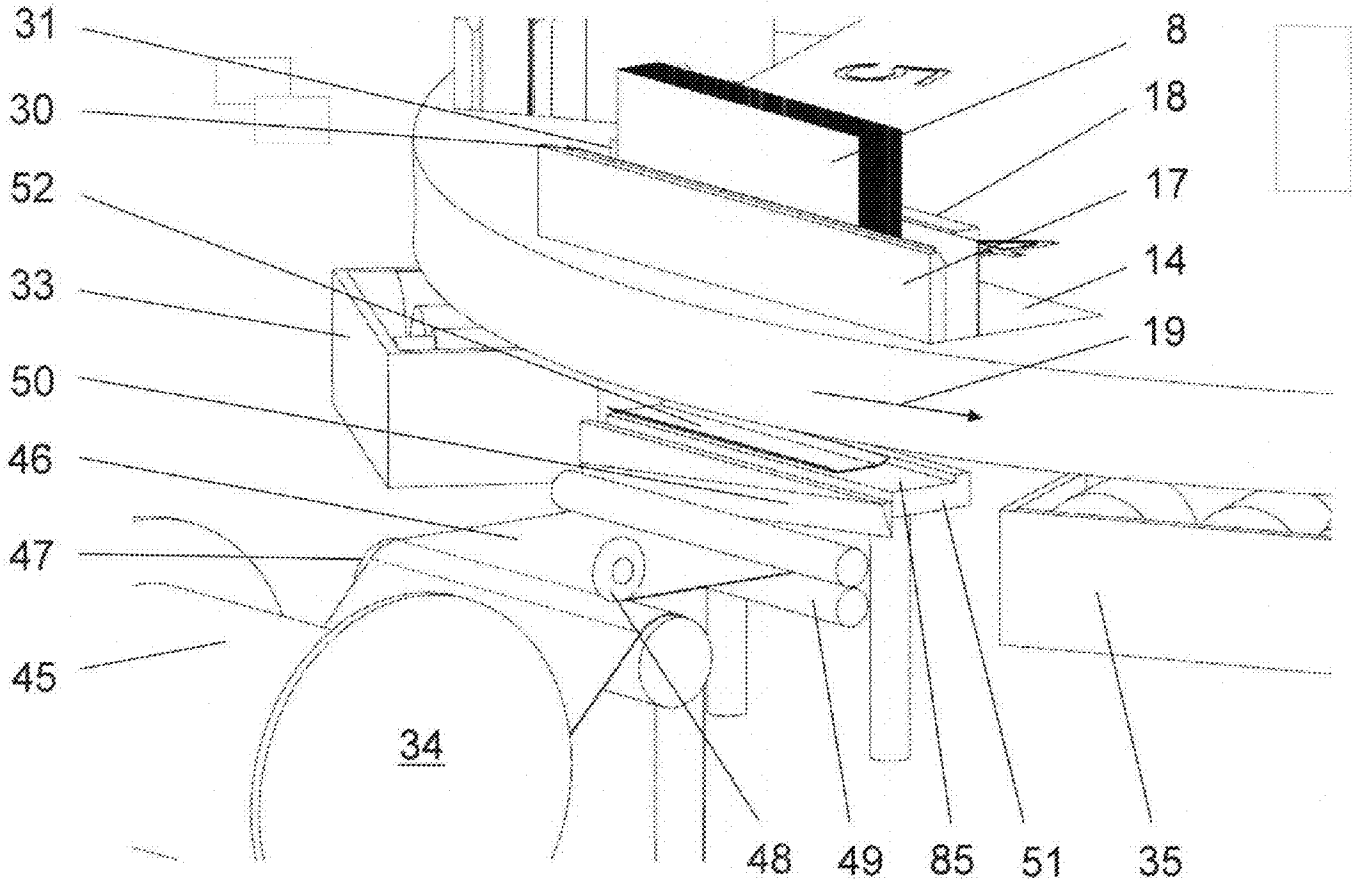
FIG. 5 is an enlarged detailed view of a station for applying the backing strip.

The station 34 for applying a backing strip, shown in further detail in FIG. 5, comprises a dispensing roller 45 for dispensing a web of backing material 46, a counter roller 47, a side-mounted knife 48, two conveying rollers 49, a cross-cutting knife 50 and a lift table 51 for the cut-off lengths of backing material 52.

Figure 6:
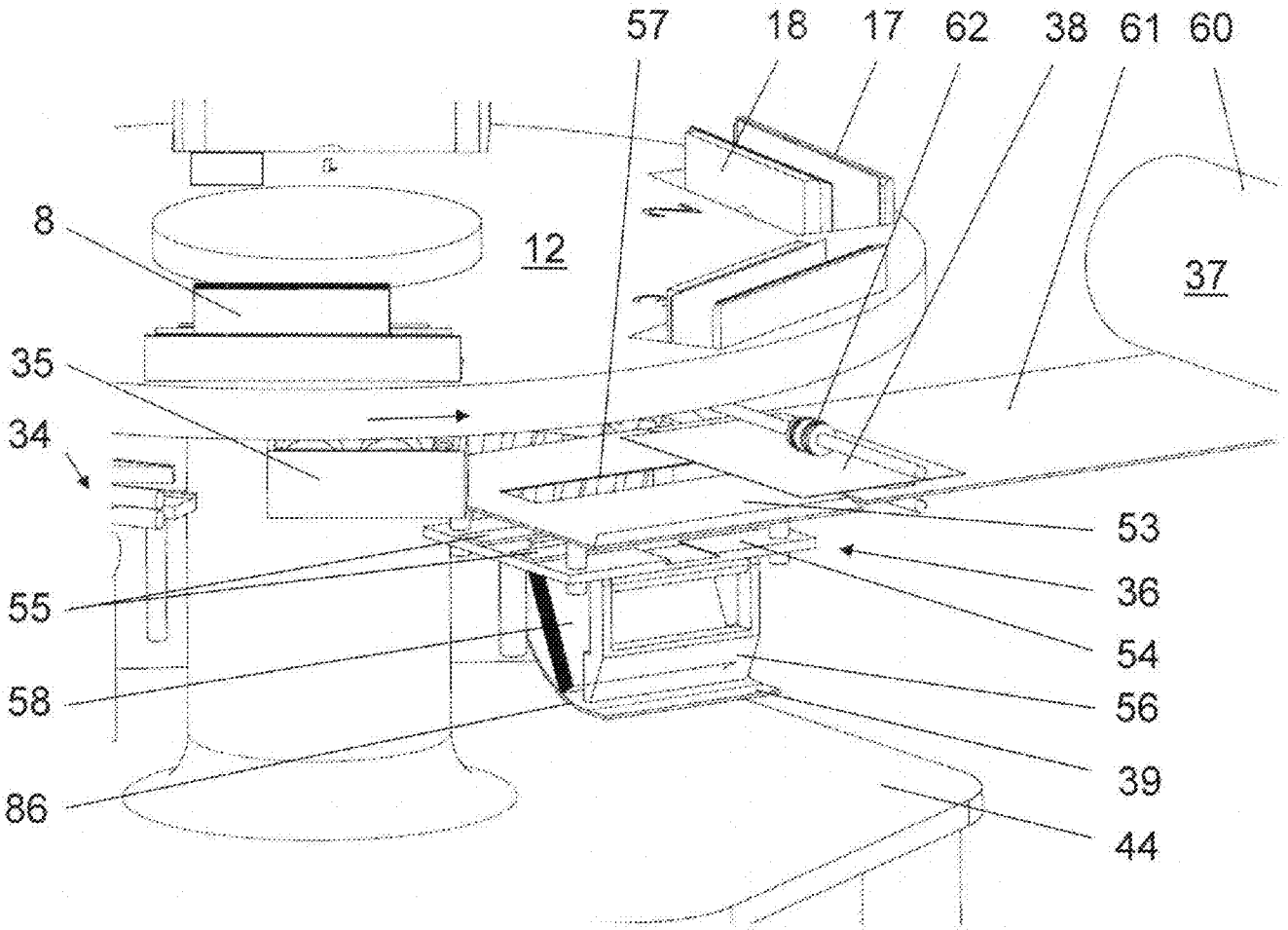
FIG. 6 is an enlarged detailed view of a pressing-on station and a delivery station.

FIG. 6 shows in further detail the press-on station 36 that operates jointly with the delivery station 39. The press-on station 36 comprises two lift tables 53, 54 that are positioned one above the other.

The lower lift table 54 includes two pressing plates 55 on its side, which can be adjusted to the thickness of the book block, as well as a bottom flap 56 that can be pivoted downward on one side and cooperates with the delivery station 39. The upper lift table 53 has a corresponding recess 57 that allows the book 58, which respectively consists of the book block 8 and the casing 38, to pass through in the direction of the delivery station 39. Centering devices (not shown) are installed on the upper lift table 53 and are used to align the casing 38 with the respective book block 8.

Referring back to FIG. 4, the casing feed station 37, which operates jointly with the press-on station 36, includes a magazine 59 and a withdrawing drum 60 for withdrawing the casings 38. A conveyor belt 61 and scoring wheels 62, arranged above the conveyor belt 61, are positioned between the withdrawing drum 60 for the casing feed station 37 and the upper lift table 53 (FIG. 6) for the press-on station 36. In the same way, adhesive-spray nozzles (not shown) for applying adhesive to the sides of the casing 38 can also be installed above the conveying belt 61.

The perfect binder 7 can be part of a system (not shown) that comprises a digital printer for producing sequentially printed sheets, preferably starting with a paper roll, for at least one book 58, a signature folder for producing folded sheets from the printed sheets, and a gathering machine that stacks the folded sheets into loose book blocks 8. These book blocks 8 can then be thread-stitched in a following operational step. Loose or thread-stitched book blocks 8 can subsequently be transferred automatically to the perfect binder 7. The system can be controlled with the aid of a super-imposed line control unit, which also transmits and coordinates the printing data for an integrated work flow, wherein the line control unit also functions to monitor the process. Of course, the perfect binder 7 can also be operated separately or as part of a different system, so as to make possible an automatic as well as a manual feeding of the book blocks 8 or the casings 38.

During the operation of the perfect binder 7, the book blocks 8 are taken over one at a time with the aid of the device 20 (FIG. 2) from a feed conveyor (not shown), which can be a conveyor belt. The book blocks 8 are then transferred to the clamping devices 1 to 6 on the rotating table 12, with the overhang necessary for the subsequent milling of the spine from below. In the process, the books blocks 8, which are supplied laying down, are placed in the upright position by the feed device 20, so that the book blocks can be taken over by the respective clamping device 1 to 6.

In the example shown in FIGS. 1 and 2, a book block 8 is supplied to the clamping device 1 where the book block 8 is initially held by the correspondingly controlled gripper halves 30, 31, meaning they are fixedly clamped in when the inside gripper 16 closes. Immediately thereafter, the movable gripper half 18 is displaced in radial direction and away from the center of table 12, thereby causing the outside gripper 15 to close as well. The book block 8 together with the inside gripper 16 then comes to rest against the outside of the gripper holder 14, for example as shown in FIG. 3, shortly before the opening of the clamping device 6. With respect to this, it must be noted that even though the rotation of the table 12 results in a constantly changing association between the clamping devices 1 to 6 and the individual processing stations 10, the numbering of the clamping devices 1 to 6 was kept the same to make easier the coordination with the Figures.

Through a corresponding turning of the rotating table 12 in conveying direction 19, the clamped in book block 8 is moved across the processing station 21 (FIG. 2) for processing the spine. The spine is milled in this way, meaning the paper fibers of the overhang on the book block 8 (not shown in FIG. 2), which projects downward from the grippers 15, 16, are exposed through the milling operation, such that the adhesive applied later on with the adhesive applicator 33 (FIG. 4) can bond optimally with the book block 8. In the intermediate opening table 22 position, the outside gripper 15 as well as the inside gripper 16 are opened, so that the book block 8 is released and drops down onto the intermediate opening table 22 where it is positioned with a new overhang for further processing. Since the intermediate opening table 22 can tilt in a downward direction, a defective book block 8 can be removed in the region of this processing station 10. During subsequent passage across the side adhesive applicator 23, a bead of adhesive is applied to the front portion and back portion of the book block 8, which is again held by the grippers 15, 16, so that the end sheets 25 can subsequently be attached to the book block 8.

The table 12 continues to rotate around its support 41, so that the book block 8, previously provided with adhesive, moves into the region of the feed station 24. FIGS. 7*a* to 7*d* show in detail the feeding of the end sheets 25 and the attaching of these end sheets 25 to the book block 8. FIGS. 7*a* to 7*d* show a diagrammatic cross-sectional view of the feed station 24 for the end sheets 25, and the clamping device 5 that cooperates with the feed station 24, as seen in the direction of arrow VII in FIG. 1.

Figure 7B:
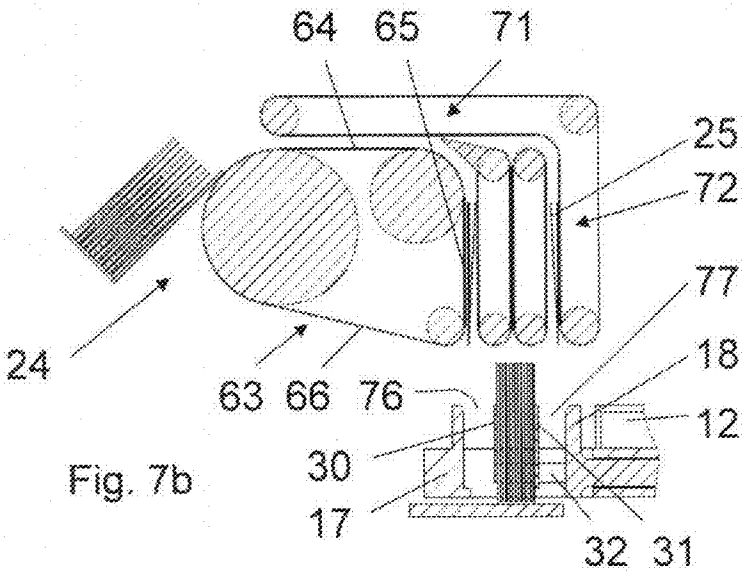
FIGS. 7*a*-7*d* is a diagrammatic cross-sectional view through a feed station for the end sheets and through a clamping device that operates jointly with the feed station, as seen in the direction of arrow VII in FIG. 1.
Figure 7D:
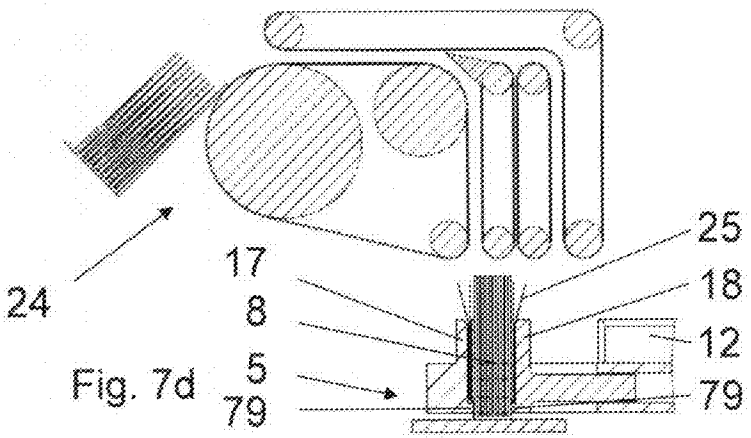
Figure 7A:
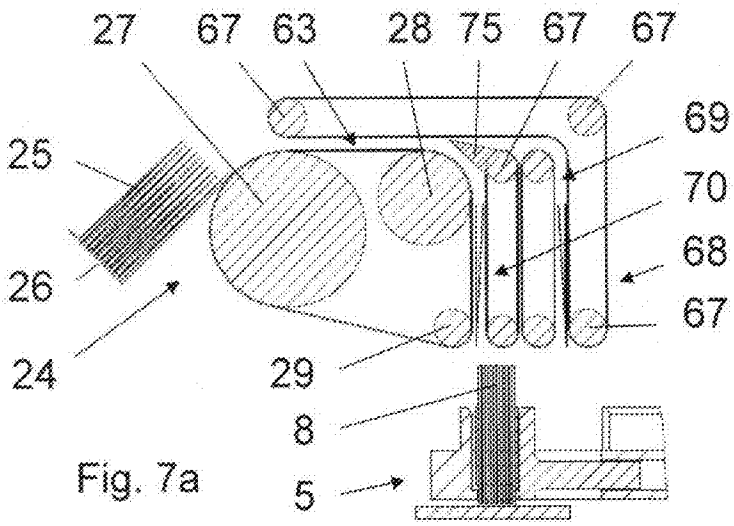

The feed station 24 comprises a conveyor belt 63, which runs over the withdrawing roller 27, the feed roller 28 and the distributor rollers 29. The conveyor belt 63 has a horizontal section 64, a vertical section 65, as well as an upward slanted section 66. The feed station 24 is furthermore provided with three additional driven belts 68, 69, 70 that respectively circulate around deflection rollers 67 (FIGS. 7*a*, 7*b*).

Two deflection rollers 67 for the belt 68 are arranged above the withdrawing roller 27 and the feed roller 28 of the feed station 24, while the third deflection roller 67 is arranged at the height of the distribution roller 29, at a distance thereto. Accordingly, the belt 68 has a horizontal region 71 as well as a vertical region 72, which extend substantially parallel to the horizontal belt section 64 and/or vertical belt section 65 of the conveyor belt 63, respectively. Two additional belts 69, 70 that respectively circulate around two deflection rollers 67 are arranged between the vertical belt section 65 of the conveyor belt 63 and the vertical region 72 of the belt 68. These additional belts are oriented substantially parallel to the vertical belt section 65 of the conveyor belt 63 and/or the vertical region 72 of the belt 68. By maintaining a corresponding distance between these belts 68, 69, 70 and to the conveyor belt 63, a horizontal conveying region 73 is created between the horizontal belt section 64 of the conveyor belt 63 and the horizontal region 71 of the belt 68. A vertical conveying region 74 for the end sheets 25 is created between the vertical region 72 of the belt 68 and the belt 69, as well as between the vertical belt section 65 of the conveyor belt 63 and the roller-side belt 70 (see FIG. 7*c*).

Once the clamping device 5 for conveying a book block 8 approaches the feed station 24, the withdrawing roller 27 successively withdraws two end sheets 25 from the magazine 26 and, with the aid of the jointly operating conveyor belt 63 and belt 68, transports these book blocks through the horizontal conveying region 73. There, the end sheets are distributed to the two vertical conveying regions 74 with the aid of a diverter 75, located on the upper deflection roller 67 of the roller-side belt 70, such that one end sheet 25 is located in each conveying region 74, as shown in FIG. 7*a*. In this position, the inside gripper 16, meaning the gripper halves 30, 31, as well as the outside gripper 15, meaning the gripper halves 17, 18, are closed and the book block 8 is secured in the clamping device 5.

If the clamping device 5 with the book block 8 moves into the region of the feed station 24, then the respective lifting mechanism moves the movable gripper half 18 radially toward the inside of the table 12, and the bolt 32 will move the inside gripper 16 in the gripper holder 14 in radial direction toward the inside of the table 12. Consequently, as shown in FIG. 7*b*, a first radial clearance space 76 is created between the outside gripper half 30 of the inside gripper 16 that continues to clamp in the book block 8 and the fixed gripper half 17 of the outside gripper 15, while a second radial clearance space 77 is created between the inside gripper half 31 of the gripper 16 and the movable gripper half 18 of the outside gripper 15.

Figure 7C:
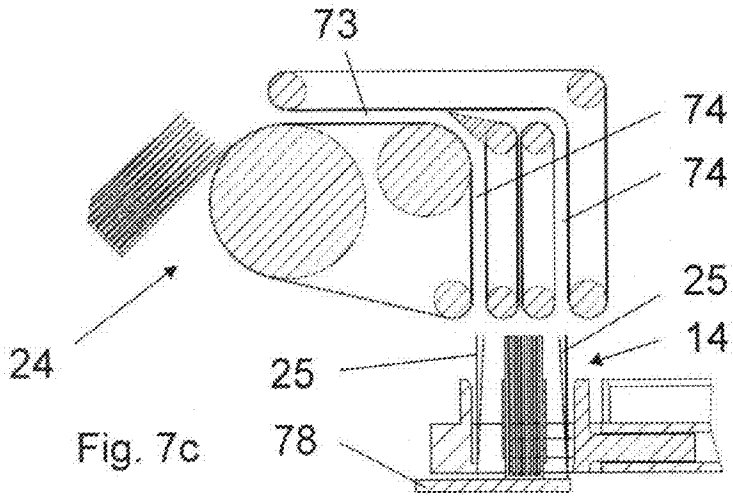

As shown in FIG. 7*c*, the end sheets 25 previously located in the two vertical conveying regions 74 are now moved into the clearance spaces 76, 77 between the grippers 15 and 16, while positioned at a distance to the sides of the book block 8. A base plate 78 is attached in this region below the table 12, which helps align the end sheets 25 so as to be flush with the book block 8.

According to FIG. 7*d*, the movable gripper half 18 together with the inside gripper 16 in the gripper holder 14 is subsequently moved in radial direction toward the outside of the table 12, so that the book block 8 as well as the end sheets 25 are held by both grippers 15 and 16. The fixed and the movable gripper halves 17, 18 of the outer griper 15 in this case are provided with an inward-directed projection 79, which presses the lower region of the end sheets 25 against the book block 8, previously provided with adhesive on the side, so that the book block 8 and the end sheets 25 are glued together. In addition, rollers (not shown) can be arranged between the base plate 78 and the table 12 for pressing the end sheets 25 against the book block 8.

Figure 8:
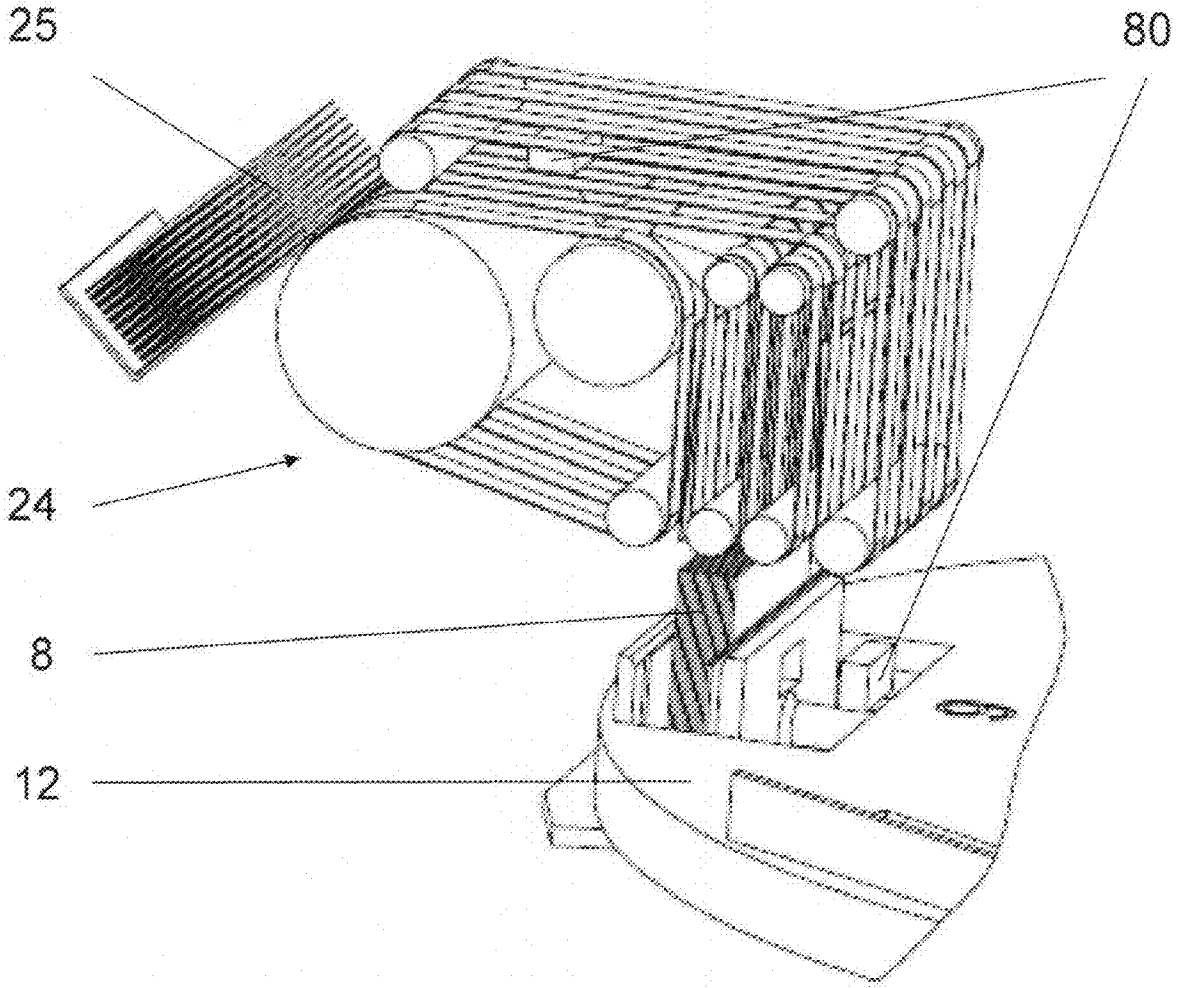
FIG. 8 is an enlarged detailed view of a feed station for the end sheets, which includes a reading device.

Referring to FIG. 8, a reading device 80 can be arranged on the feed station 24 for the end sheets 25, as well as on one or more of the clamping devices 1-6, wherein only the clamping device 6 is shown in FIG. 8. The reading devices 80 can be used to detect the identifying characteristics of the end sheets 25, and to compare these characteristics to previously readout identifying characteristics on the book block 8. In case of a negative result, the respective book block can be removed automatically, or an intervention by the machine operator can be triggered.

Figure 9:
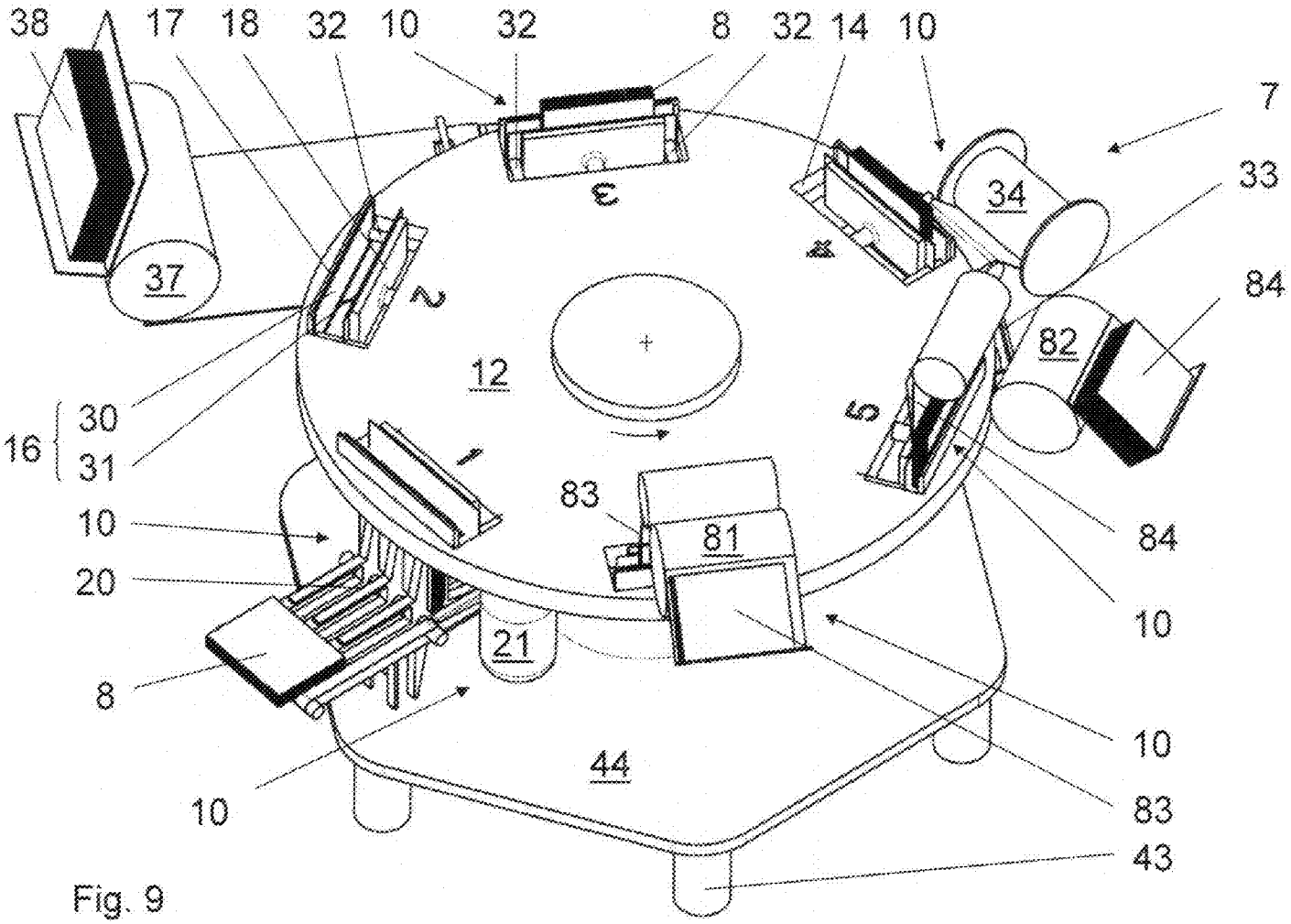
FIG. 9 is a perspective view of an alternative embodiment of the invention with two feed stations for the end sheets.

FIG. 9 shows an alternative embodiment having one feed station 81, 82 for each end sheet 83, 84, instead of a single feed station 24. A separate adhesive applicator for applying adhesive to the sides is arranged in this case in front of each feed station 81, 82, and the intermediate opening table 22 can be omitted. Otherwise, the perfect binder 7 of FIG. 9 is configured the same as the embodiments described previously.

The operation of the embodiment of FIG. 9 also differs in that a bead of adhesive is applied only to the front of the book block 8 passing over the first adhesive applicator for attaching the front end sheet 83 to the book block 8. In the same way, a bead of adhesive is applied only to the back of the book block 8 when passing over the second adhesive applicator, so that the back end sheet 84 can be attached to the back of the book block 8.

Once the book block 8 that is coated with adhesive on the front side enters the region of the first feed station 81, the movable gripper half 18, as well as the inside gripper 16 in the gripper holder 14, are moved in the radial direction toward the inside of table 12, so that a first radial clearance space is created between the outside gripper half 30 of the gripper 16 that continues to grip the book block 8, the inside gripper 16 and the immovable gripper half 17 of the outside gripper 15. The end sheet 83 is then inserted into this clearance space. If the book block 8 reaches the region of the second feed station 82, then the movable gripper half 18 in the gripper holder 14 is moved toward the inside while the inside gripper 16 remains in its position on the outside of the gripper holder 14, meaning directly adjacent to the fixed gripper half 17. As a result, a second radial clearance space is created that extends downward to the base plate 78 (see FIG. 7*c*). This clearance space extends between the inside gripper half 31 of the inside gripper 16 that continues to clamp in the book block 8 and the movable gripper half 18 of the outside gripper 15, so that the second end sheet 84 can be inserted into this second clearance space.

Once the end sheets 25 (e.g., of FIG. 2) or alternatively the end sheets 83, 84 (e.g., of FIG. 9) have been supplied and glued to the sides of the book block 8, the book block 8 moves across the adhesive applicator 33. In the process, a defined coat of adhesive is applied to the book block spine. The book block 8 then moves with the aid of the clamping device 4 into the region above the station for applying the backing strip 34, as shown in FIG. 5. Starting with a backing material web 46, a backing strip 52 is cut to the correct length and width dimensions at this station, using the knife 50 for cutting across and a side knife 48 for cutting lengthwise. The backing strip 52 is placed onto the lift table 51 and is held in place thereon with the aid of nozzles (not shown), which are arranged in the bottom 85 of the lift table 51. As soon as the above-arranged book block 8 is in the correct position, the lift table 51 is moved upward and pushes the backing strip 52 against the adhesive-covered spine of the book block 8. Alternatively, the two grippers 15, 16 can also be released, so that the released book block 8 can either be pressed against the backing strip 52 by its own weight, or is moved downward with a corresponding device. In the latter case, the book block 8 that is provided with the backing strip 52 must then be picked up once more by the two grippers 15, 16.

During the further transport, a bead of adhesive is applied near the spine to both sides of the book block 8 with the side adhesive applicators 35. These adhesive beads are intended for gluing the backing strip 52 against the sides in the following press-on station 36 (shown in FIG. 6). If the book block 8 processed in this way reaches the region of the press-on station 36, with the clamping device 3, the two pressing plates 55 of the lower lift table 54 move toward each other until they reach the required book thickness and, in the process, press the backing strip 52 against the side. At that instant, the outside gripper 15 as well as the inside gripper 16 of the clamping device 4 open up as a result of the corresponding activation of the lifting mechanism and/or because they are acted upon by the bolt 32, so that the book 58, comprising the book block 8, the end sheets 25 or 83, 84, and the backing strip 52, is now held exclusively by the pressing plates 55.

Referring to FIG. 6, for the production of a soft cover book, a casing 38 is supplied via the conveyor belt 61 of the casing feeder 37 to the upper lift table 53 of the press-on station 36, wherein this casing has been scored accordingly by the scoring wheels 62. During the transport of the casing 38 on the conveyor belt 61, several beads of adhesive are applied with an adhesive spray device (not shown) or a different adhesive applicator, to the casing 38 for a downstream gluing together of the book block 8 and the end sheets 25 or 83, 84.

If the casing 38 is positioned completely on the upper lift table 53, the two lift tables 53, 54 that were previously in the lowered position move upward and push the casing 38 against the spine of the book block 8, which has in the meantime been moved to be directly above the lift tables 53, 54. Following this, the book 58, comprising the book block 8 and the casing 38, are also held exclusively by the pressing plates 55.

During the production of hardcover books as well as softcover books, the two lift tables 53 and 54 move downward together with the clamped-in book 58. The upper lift table 53 remains stationary on the level of the conveyor belt 61 for the casing feeder 37, while the lower lift table 54 pulls the book 58 farther down and through the recess 57 of the upper lift table 53. As soon as the book 58 is released by the side pressing plates 55, the downward pivoting bottom flap 56 opens up and accompanies the book 58 in a careful manner around the delivery 39, which has a downward-curving surface 86. In this process, all necessary format adjustments occur dynamically via suitable drive elements. For example, servo motors can be used to adjust the pressing force. In order to reduce the structural length, the casings 38 can be conveyed in an overlapping flow on the conveyor belt 61.

Downstream of the delivery station 39, the book 58 is taken over by a conveying device (not shown). The clamping device 3, which is emptied in this way, is then ready to accept another book block 8.

The transporting device 9, meaning the table 12, is driven continuously during the perfect binding operation, so that the book block 8 is processed during the transport and the end sheets 25 or 83, 84 are supplied to each clamping device 1-6 that moves forward in the conveying direction 19. Several processing stations 10 can be embodied so as to synchronously follow the respective book block 8 for a specific time period. For example, this applies to the feed station 24 (FIG. 2) that supplies the end sheets 25, as well as the feed stations 81, 82 (FIG. 9) that supply the end sheets 83, 84. As a result, the relative speed between the book block 8 and the end sheets 25, 83, 84 to be supplied in the conveying direction 19 is advantageously equal to or at least approximately zero.

Alternatively, an intermittent operation of the device is also possible, so that at least some of the processing steps are realized while the conveying device 9 is stopped, meaning while the clamping devices 1-6 and the book block 8 are stopped. In that case, the following operating steps are performed during a stop phase: feeding of the book block 8; the intermediate opening; feeding of the end sheets 25 or 83, 84; feeding of the backing strip 52 and the casing 38; and conveying away of the book 58. The following operating steps are performed during the conveying of the book block 8: processing the spine; and applying the adhesive. In the process, the conveying device 9 is moved intermittently in the conveying direction 19, thereby also moving the clamping devices 1 to 6 intermittently to the individual processing stations 10. The grippers 15, 16 can be opened or closed as needed, and the book blocks 8 can accordingly be clamped in or released. The adhesive applicators 23, 33, and 35, as well as any additional adhesive applicators (if applicable), can be arranged to move in a horizontal plane below the table 12. They can be moved with the aid of a control cam, not shown, such that they follow the chord defined by the book block 8 that is held inside the clamping devices 1 to 6, thereby ensuring a uniform application of the adhesive.

The perfect binder 7 permits a dynamic and cyclical realization of all format adjustments for the clamping devices 1 to 6, and the processing stations 10, so that book blocks with different formats and thicknesses can be processed simultaneously. A thin, small book can therefore follow a thick, large book or vice versa. The perfect binder 7 can also be used for producing individual books (one copy), meaning a unique book block 8 can be clamped into each clamping device 1 to 6. Since all required processing stations 10 are arranged on the perfect binder 7, a book block 8 for producing a hardcover book can follow cyclically a book block 8 for producing a softcover book.

The perfect binder 7 is provided with a control unit 87, indicated in FIG. 1, which can process book data from various sources and is connected in a manner not shown herein with measuring elements and control elements for the conveying device 9 and the processing stations 10. The aforementioned book data can include, for example, the book ID (identification), the order ID, the unbound book height, the unbound book width, and the book thickness. In addition, the casing height, the casing width, the center deviation for the casing (position reference spine to casing edge), and the casing thickness can be used. These data can be entered manually in the form of a command into the control unit 87, or alternatively, can be transmitted to the control unit 87 by a respective detection device. If the perfect binder 7 is arranged together with a compatible control system, the required book data can be transmitted, for example, by a central control unit, or by the control unit of a machine within the combined system. Finally, the book data can also be transmitted along with the book block 8 or the casing 38, detected with the aid of a reading device arranged in the perfect binder, and then transmitted to the control unit 87. Book-binding information can also be transmitted via a database entry coming from a central control unit, for example, once a corresponding identification is read off the book block 8 or the casing 38.

Depending on the operating conditions, it is possible to use a table 12 having more or fewer than six gripper holders 14 and clamping devices. Similarly, not all existing clamping devices need to be utilized during the perfect binding operation.

A perfect binder 7 according to the present invention can also be used to produce perfect-bound soft covers, for which the spine of a supplied book block 8 is initially milled, followed by application of adhesive, and then application of a casing 38 supplied by a casing feeder 37 to the book block. In this case, the feed stations 24, 81, 82 for the end sheets 25, 83, 84, respectively, and the backing strip station 34 may be turned off. The adhesive applicator 33 for applying adhesive to the spine can be positioned in front of the press-on station 36, which precisely presses the casing 38 against the book block 8. For hardcover production, the press-on station can be used to press on the backing strip 52. In addition, the feed section for the casing feeder 37 should be long enough such that the correct casing 38 for the respective book block 8 can be moved synchronously into the conveyed flow.

In general, the perfect binder 7 according to the present invention also allows positioning several adhesive applicators or adhesive spray stations at different locations, so that the type of adhesive application can be changed cyclically. As a result, it is possible to produce a softcover book immediately following a hardcover book, and vice versa. Of course, the adhesive binder 7 can also be configured to product strictly softcover books or strictly hardcover books.

Figure 10:
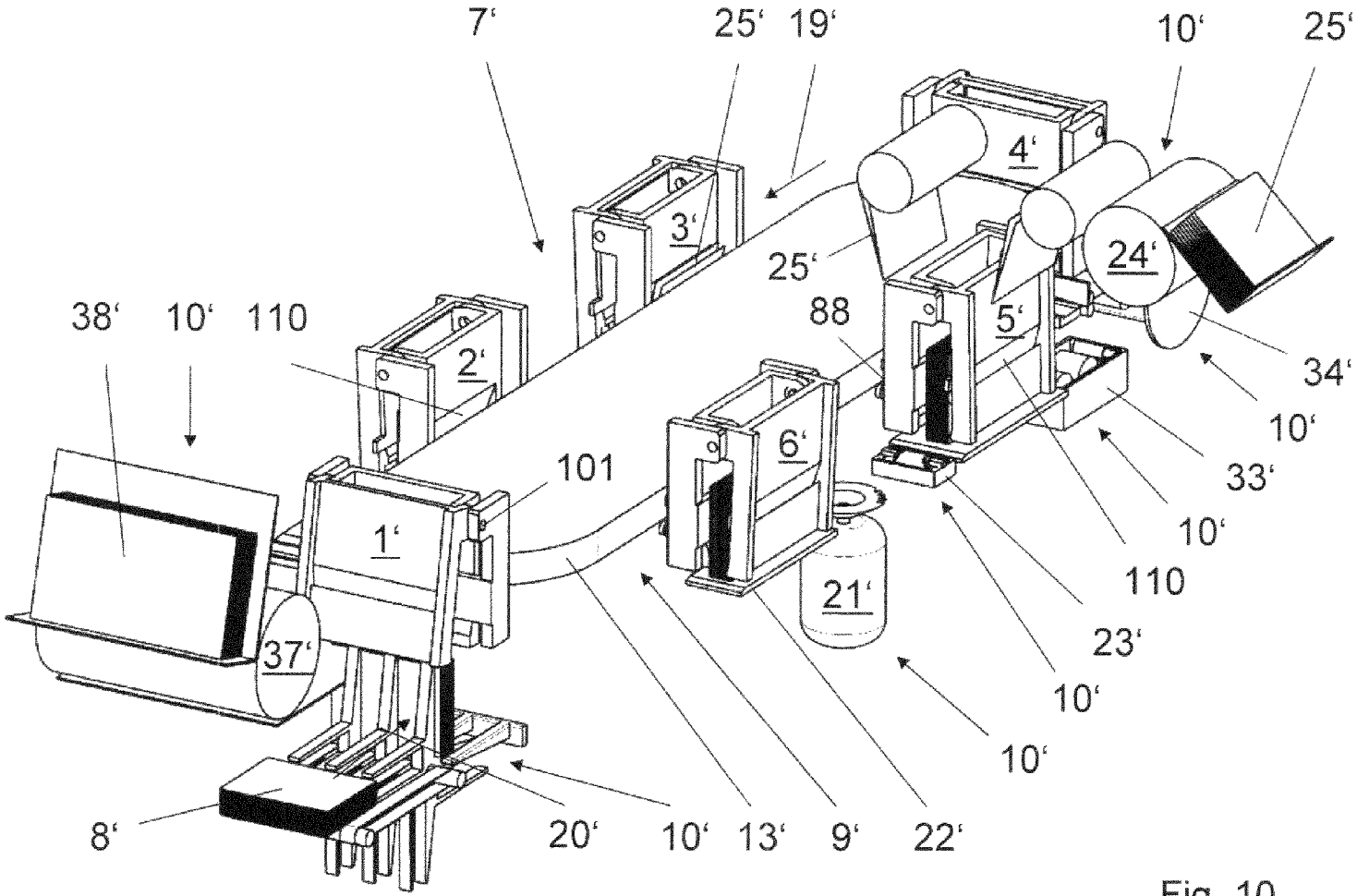
FIG. 10 is a perspective view of a perfect binder according to a second embodiment of the invention.

Referring to FIG. 10, a second embodiment of a perfect binder 7' according to the present invention is shown in front-side perspective view. According to this embodiment, the conveying device 9' has a closed, oval circulating path 13'. The perfect binder 7' includes processing stations 10' that can be configured in the same way as those for the first embodiment, meaning a station 20' for feeding the book blocks 8', a spine processing station 21', an adhesive applicator 23' for applying adhesive to the sides, a station 24' for supplying two individual end sheets 25', an additional adhesive applicator 33', a backing strip station 34', as well as a casing feeder 37' that works in combination with a press-on station (not shown) and a delivery station (not shown) and supplies the casings 38'. The clamping device 6' is located in the region of an intermediate opening table 22' where the book block 8' can be aligned by jogging.

In the same way as the conveying device 9 for the first embodiment, the conveying device 9' is also driven continuously during the perfect binding operation, meaning the book block 8' is processed during the conveying operation. The end sheets 25' are subsequently supplied to each of the clamping devices 1' to 6', which advance in conveying direction 19'. Several of the processing stations 10', for example the feed station 24' for feeding the end sheets 25', in this case can also be configured to synchronously follow the respective book block 8' for a specified period of time. In the same way as for the first embodiment, the drive can also function intermittently or in an alternating manner, so that at least some of the processing steps can be realized while the conveying device 9' is stopped, meaning the clamping devices 1' to 6' and the book blocks 8' are stopped as well. The individual processing steps for the perfect binding operation are carried out in substantially the same way as for the first embodiment.

In contrast to the first embodiment, the perfect binder 7' includes a conveying chain (not shown) that functions as a traction element for the clamping devices 1' to 6', wherein the clamping devices 1' to 6' are each provided with a guide element 88 for attaching them to the conveying chain. Each guide element 88 is provided with four horizontal drive rollers and four vertical drive rollers 89, 90 (shown in FIGS. 11*a-c*) that engage in the conveying chain. The clamping devices 1' to 6' are connected to the conveying chain in this manner. Thus, the book blocks 8', which are gripped by the clamping devices 1' to 6', are conveyed with the aid of a chain drive (not shown) to the respective processing stations 10'.

Figure 11A:
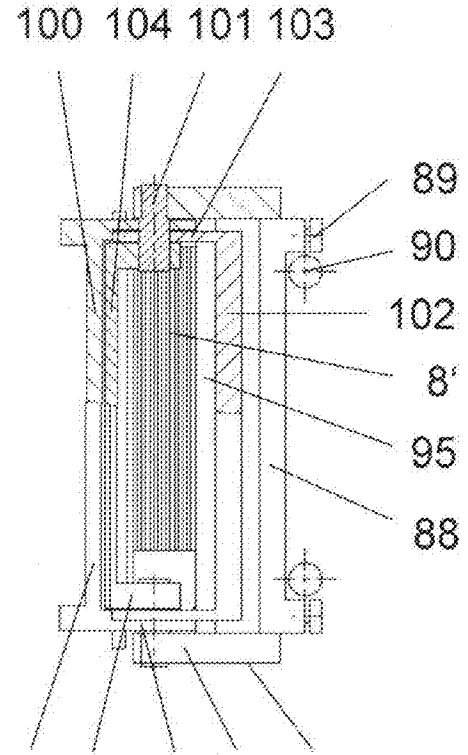
FIGS. 11*a*-*c* depict a sectional view, and two side-perspective views, respectively, of a gripper.
Figure 11B:
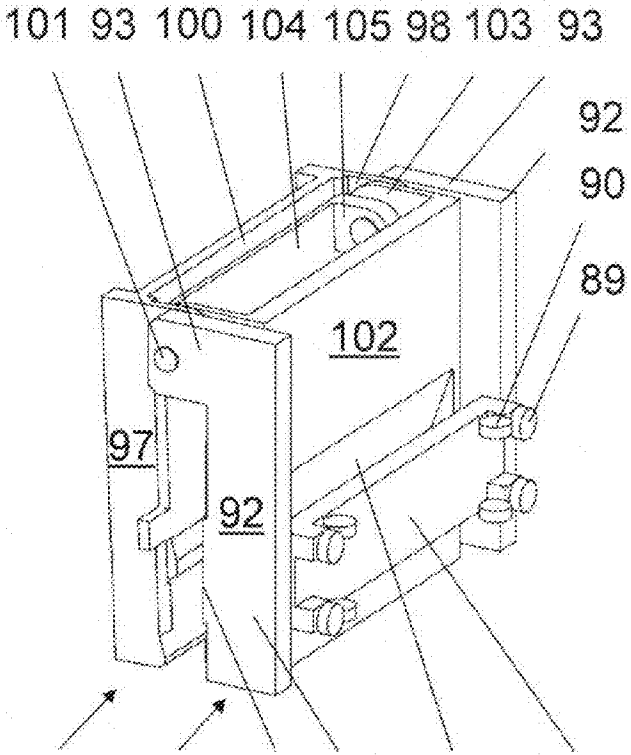
Figure 11C:
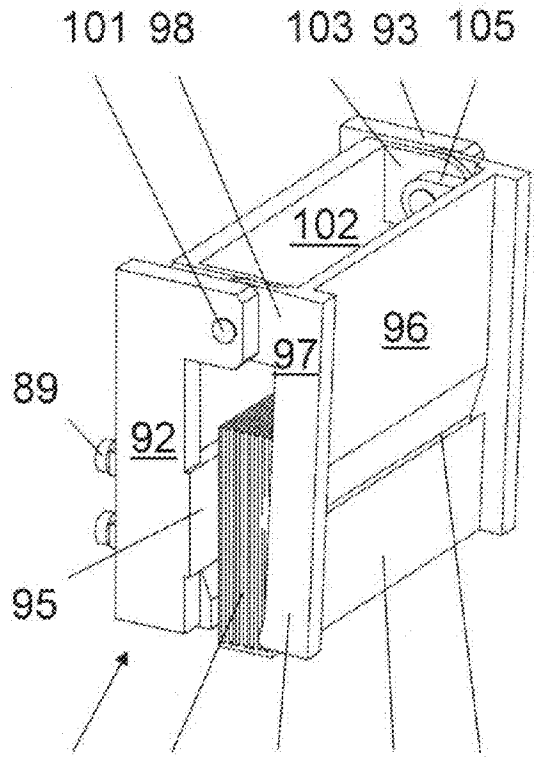

Turning to FIGS. 11*a* to 11*c*, each clamping device 1' to 6' includes a first holding element 91, which is attached to the guide element 88 and comprises two reverse L-shaped side parts 92 with respectively one short and one long leg 93, 94, as well as a cross strut 95 that connects the side part 92 on the inside, in the lower region of the long leg 94. In addition, a second holding element 96 also comprises two reverse L-shaped side parts 97 with respectively one short and one long leg 98, 99. A cross strut 100 connects the side parts 97 along the complete length in such a way that the second holding element 96, when viewed from above, has an approximately double T-shaped form.

The adjacent short legs 93, 98 for the two holding elements 91, 96 are connected in an articulating manner along one rotational axis 101, wherein the short leg 93 of the first holding element 91 is arranged on the outside and the short leg 98 of the second holding element 96 is arranged on the inside. A third holding element 102, which encircles the cross strut 95 of the first holding element 91, is arranged between the two side parts 92 of the first holding element 91, so as to extend over the complete length of the first holding element. The third holding element 102 includes two projections 103 that form an articulating connection along the rotational axes 101. The two projections 103 in this case are located within the short legs 98 of the second holding element 96. Arranged on the inside of the second holding element 96 is a plate-shaped fourth holding element 104, which also includes two projections 105 that point toward the inside and are attached in an articulating manner along the rotational axes 101. The projections 105 are located within the projections 103 of the third holding element 102.

Figure 12A:
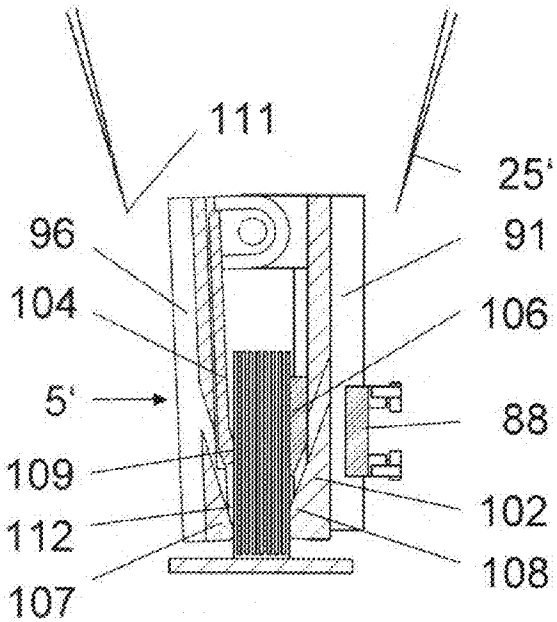
FIGS. 12*a*-*d* depict sectional views of a gripper during the feeding of the end sheets.
Figure 12B:
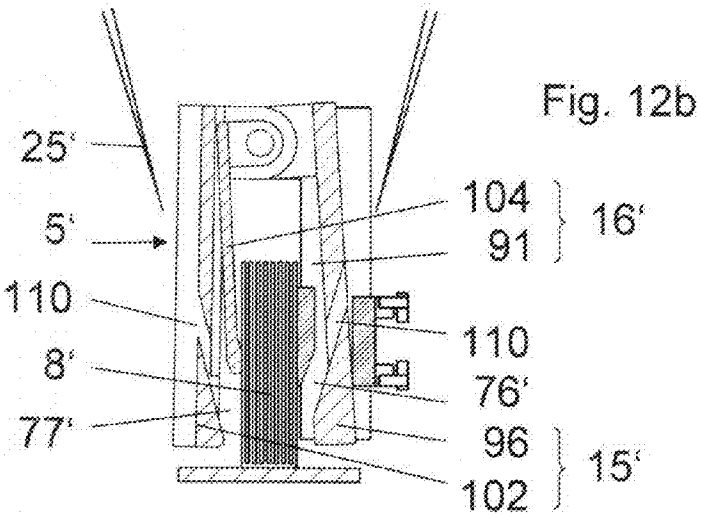
Figure 12C:
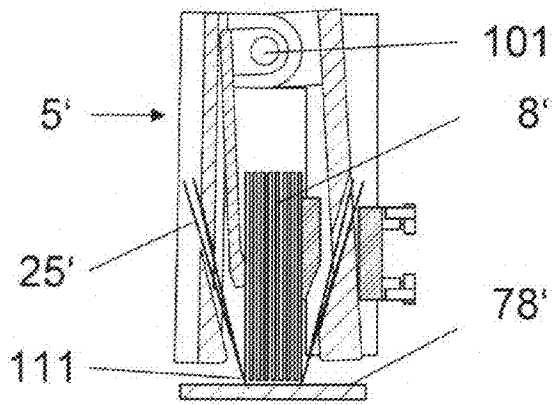
Figure 12D:
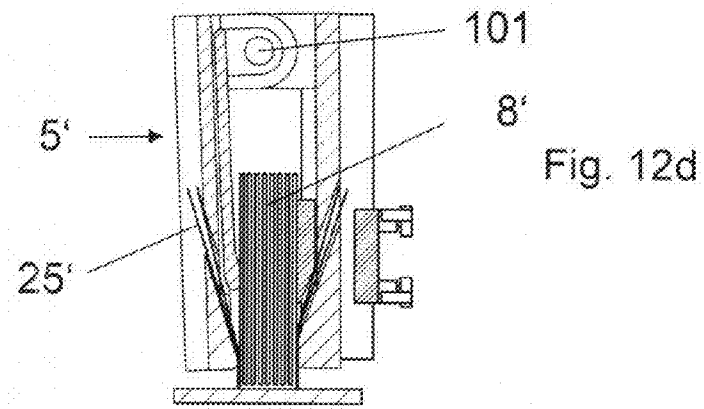

Referring to FIG. 12*b*, the clamping devices 1' to 6' may each comprise one outside gripper 15' and one inside gripper 16'. The outside gripper 15' in this case comprises the second and third holding elements 96, 102, while the inside gripper 16' comprises the first and fourth holding elements 91, 104. The holding elements 91, 96, 102, 104 may be configured to pivot around the two rotational axes 101, so that the clamping devices 1' to 6' can pick up the book blocks 8', clamp them in, and transport and release them as needed. The four holding elements 91, 96, 102, 104 of the clamping devices 1' to 6' can each include a surface 106, 107, 108, 109 that protrudes toward the inside, as shown in FIGS. 12*a-d*.

The second and third holding elements 96, 102 of the clamping devices 1' to 6' each include a pocket-type recess 110, which extends through the respective holding element 96, 102. The pocket-type recesses 110 operate to supply the end sheets 25' to the clamping devices 1' to 6' from the side.

To accommodate a book block 8', FIG. 10 shows that the clamping device 1', meaning the outside and the inside grippers 15', 16' (shown in FIG. 12*b*), are opened with the aid of a control mechanism (not shown), and closed again once the book block 8' is positioned in place. For this operation, the holding elements 91, 96, 102, 104 for the grippers 15', 16' are correspondingly pivoted around their rotational axis 101. The opening angle for the gripper 15', 16' depends on the thickness of the book.

Corresponding to FIG. 10, the FIGS. 12*a-d* illustrate the feeding of two end sheets 25' to the clamping device 5' located in the region of the feed station 24'. The end sheets 25' are moved with the aid of the feed station 24' from the top down to the area near the pocket-type recesses 110 in the clamping device 5' used to convey the book blocks 8' at that time. The end sheets 25' are subsequently moved with the aid of feed means (not shown) with the fold 111 pointing forward, into the recesses 110 where they initially drop to the pocket bottom 112 and are temporarily stored there. The end sheets 25' can be pre-aligned parallel to the book block 8' inside these pocket-type recesses by using means not shown herein. The second and the third holding elements 96, 102 are then pivoted toward the outside via corresponding control mechanisms, meaning the outside gripper 15' is opened while the inside gripper 16' remains closed and continues to clamp in the book block 8' . As a result of opening the outside gripper 15', a clearance space 76', 77' is created below the gripper 16' on each side of the book block 8', meaning between the book block and the second and third holding elements 96, 102. The respective end sheets 25' subsequently drop further with the fold 111 pointing forward into this clearance space, until they reach the base plate 78', where they are oriented parallel to the book block 8'. The end sheets are glued together with the book block 8' by making use of the inward projecting surfaces 107, 108 of the holding elements 96, 102, which press the end sheets 25' against the sides of the book block 8' that were previously provided with adhesive. The relatively short distance from the pocket bottom 112 to the base plate 78' results in a relatively short drop, thus ensuring that the end sheets 25' and the book block 8' are precisely glued together. Since the end sheets 25' remain with their upper region inside the pocket-type recess 110 after being glued to the book block 8', they do not completely contact the book block 8' until the book block 8' is removed from the respective clamping device 1' to 6'. With the gripper 15' opened up, the end sheets 25' can also be fed directly through the recesses 110 to the book block 8' and can be pressed against the book block.

According to an alternative embodiment, the end sheets 25' can be inserted into the clamping devices 1' to 6' before the book blocks 8' (i.e., into the pocket-type recesses 110), and stored temporarily therein. For example, this can occur between the delivery of a perfect bound book and the feeding 20' of the following book blocks 8'. If the grippers 15' and 16' are closed, the end sheets 25' only drop onto the pocket bottom 112 (FIG. 12*a*) where they are pre-aligned.

The pocket-type recesses 110 in the clamping devices 1' to 6' can also be used to supply flat items other than the end sheets 25' to the book blocks 8', such as CD pockets or the like.

Figure 14:
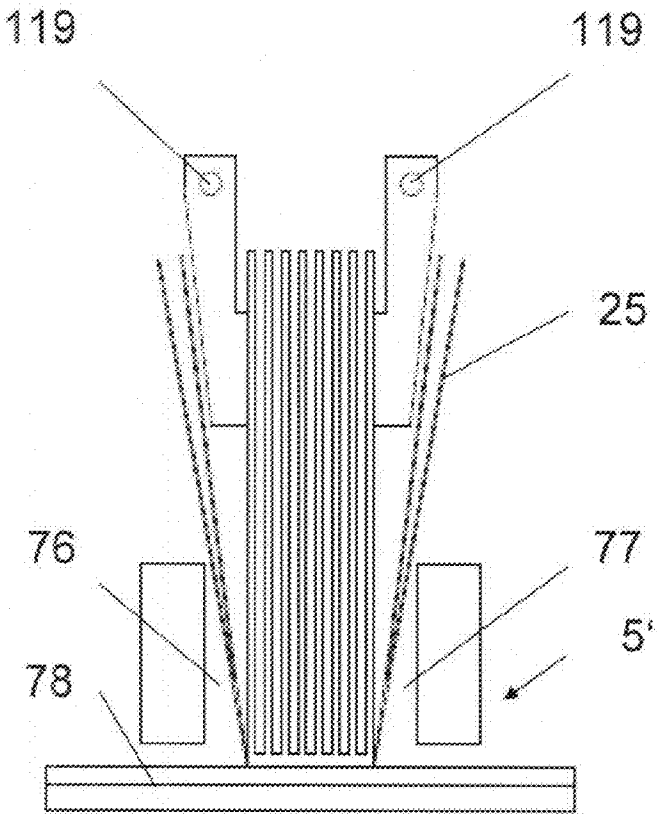
FIG. 14 is a side view of the clamping device of FIG. 14, with the end sheets already inserted.
Figure 13:
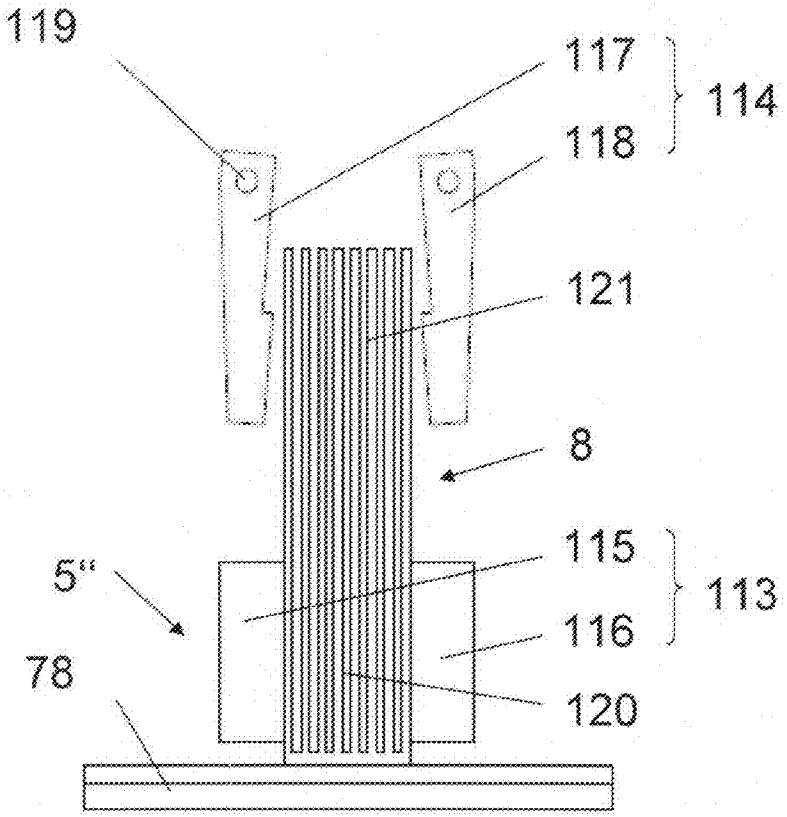
FIG. 13 is a side view of a clamping device in the region of a feed station on a perfect binder, according to a third embodiment of the invention.

A third embodiment includes modified versions of the clamping devices 1' to 6', wherein the clamping device 5" shown in FIGS. 13 and 14 is representative of them all. The clamping device 5' includes a first gripper 113, which is embodied as clamping gripper, attached on or in the conveying device (not shown). In addition, a stationary second gripper 114, which is also embodied as clamping gripper for the book blocks 8, 8', is arranged at the feed station for the end sheet 25, 25', 83, 84 (not shown), and is attached above and at a distance to the first gripper 113. The first and the second grippers 113, 114 each comprise two gripper halves 115, 116 and 117, 118, respectively, which can be moved toward each other. The gripper halves 117, 118 of the second gripper 114 are each attached with a joint 119 to the feed station for the end sheets 25, 25', 83, 84 (not shown), and are opened and closed via a control mechanism (not shown). Alternatively, one of the gripper halves 116, 118 in each pair can be fixed, and the other gripper halves 115, 117 can move relative thereto.

During the operation of a perfect binder equipped with grippers 113, 114, the book blocks 8 are initially gripped in a lower region 120 by the clamping devices, meaning by the first grippers 113, and are then transported to the processing stations. Once a book block 8 arrives at the feed station for the end sheets 25, indicated by the second gripper 114 as shown in FIG. 13, the book block is then gripped in an upper region 121 by the second gripper 114. Following this, the first gripper 113 is opened, so that a clearance space 76, 77 is created on each side of the book block 8. An end sheet 25 is inserted into each clearance space 76, 77 until it reaches the base plate 78. Once the first grippers 113 close again, the end sheets 25 are pressed with their lower region 120 against the book block 8 and are thus glued to it. Following the opening of the second gripper 114, the book block 8 is again released and is then conveyed to the following processing station.

As an alternative to the previously described embodiments, the closed circulating path 13, 13' for the conveying device 9, 9' can be embodied as a multi-cornered path or as a non-circular curve. Also, the grippers of the second embodiment can also be used with the perfect binder 7 having a closed circulating path 13 that is circular in shape.

It will be understood that the above description of the present invention is susceptible to various modifications, changes and adaptations, and that the same are intended to be comprehended within the meaning and range of equivalents of the appended claims.

What is claimed is:

1. A perfect binder for processing book blocks, comprising:

a conveying device adapted to convey the book blocks along a closed circulating path, the conveying device including a plurality of clamping devices each adapted to convey a book block; and a plurality of processing stations arranged successively along the closed circulating path, each of the processing stations having its own drive;

wherein one of the processing stations comprises a spine-processing station, and another one of the processing stations comprises an end sheet feed station following the spine-processing station;

wherein the clamping devices are attached to the conveying device, and each clamping device comprises an outside gripper and an inside gripper arranged inside the outside gripper.

2. The perfect binder according to claim 1, wherein the outside gripper comprises an immovable gripper half and a movable gripper half, and the inside gripper comprises a pair of movable gripper halves.

3. The perfect binder according to claim 1, wherein the clamping devices each include a first gripper attached to the conveying device, and a second gripper located at the end sheet feed station, wherein the second gripper is located above the first gripper at a distance from the first gripper.

4. A perfect binder for processing book blocks, comprising:

a conveying device adapted to convey the book blocks along a closed circulating path, the conveying device including a plurality of clamping devices attached to the conveying device, each clamping device adapted to convey a book block and comprising an outside gripper and an inside gripper arranged inside the outer gripper; and a plurality of processing stations arranged successively along the closed circulating path;

wherein one of the processing stations comprises a spine-processing station, and another one of the processing stations comprises an end sheet feed station following the spine-processing station;

wherein the outside gripper comprises a pair of first holding elements and the inside gripper comprises a pair of second holding elements, and the pair of first holding elements and the pair of second holding elements pivot around a common rotational axis.

5. The perfect binder according to claim 4, wherein each holding element of the pair of first holding elements includes a recess extending therethrough.

6. The perfect binder according to claim 3, wherein the first gripper and the second gripper each comprise a first gripper half and a second gripper half, wherein at least one of the first and second gripper halves is movable relative to the other of the first and second gripper halves.

7. The perfect binder according to claim 1, further comprising a reading device adapted to identify the end sheets, wherein the reading device is located at the end sheet feed station, or at one of the clamping devices.

8. The perfect binder according to claim 1, wherein the closed circulating path is circular, oval, polygonal, or curved.

9. A method for the perfect binding of book blocks, comprising:

conveying the book blocks around a closed circulating path with each book block clamped in a clamping device of a conveying device, wherein a plurality of processing stations are arranged successively along the closed circulating path, wherein each processing station has its own drive;

milling the spine of each book block at one of the processing stations; and subsequently, inserting at least one end sheet into the clamping device at a downstream end sheet feed station;

wherein the clamping devices are attached to the conveying device, and each clamping device comprises an outside gripper and an inside gripper arranged inside the outside gripper.

10. The method according to claim 9, wherein inserting the at least one end sheet into the clamping device comprises:

inserting the end sheet into the clamping device with a lateral spacing between the end sheet and the book block, and subsequently pressing the end sheet against the book block with the clamping device.

11. The method according to claim 9, wherein the at least one end sheet is initially stored in the clamping device, and is subsequently supplied to and pressed against the book block.

12. The method according to claim 9, further comprising:

conveying each of the book blocks to one of the processing stations while gripping a lower region of each book block with a respective one of the clamping devices, wherein one of the book blocks is conveyed to the end sheet feed station;

gripping an upper region of the book block that is conveyed to the end sheet feed station with a gripper and subsequently opening the clamping device from the lower region of the book block;

subsequently inserting at least one end sheet into the opened clamping device;

closing the clamping device on the lower region of the book block and releasing the gripper from the upper region of the book block; and conveying the book block to another one of the processing stations.

13. The method according to claim 9, further comprising:

operating the conveying device continuously in a conveying direction; and supplying the at least one end sheet to a clamping device that is moving in the conveying direction.

14. The method according to claim 9, further comprising:

operating the conveying device intermittently; and supplying the at least one end sheet to a clamping device that is stopped.

15. The method according to claim 9, further comprising:

inserting the at least one end sheet into the clamping device before inserting the book block into the clamping device; and temporarily storing the at least one end sheet in the clamping device.

16. The method according to claim 15, further comprising:

supplying flat items to the clamping device.

* * * * *